US009079180B2

(12) United States Patent
Momose

(10) Patent No.: US 9,079,180 B2
(45) Date of Patent: Jul. 14, 2015

(54) MICROCHIP AND METHOD OF USING MICROCHIP

(75) Inventor: Shun Momose, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 916 days.

(21) Appl. No.: 12/238,876

(22) Filed: Sep. 26, 2008

(65) Prior Publication Data

US 2009/0084738 A1 Apr. 2, 2009

(30) Foreign Application Priority Data

Oct. 1, 2007 (JP) ..... 2007-257400

(51) Int. Cl.
*B01L 3/00* (2006.01)

(52) U.S. Cl.
CPC ... *B01L 3/502738* (2013.01); *B01L 2200/0642* (2013.01); *B01L 2200/0689* (2013.01); *B01L 2200/16* (2013.01); *B01L 2300/0803* (2013.01); *B01L 2300/0816* (2013.01); *B01L 2400/0409* (2013.01); *B01L 2400/0677* (2013.01); *Y10T 436/00* (2013.01); *Y10T 436/11* (2013.01)

(58) Field of Classification Search
CPC ..... B01L 3/502738; B01L 2200/0642; B01L 2200/0689; B01L 2200/0677; B01L 2200/0803; B01L 2200/0816; B01L 2200/0409; B01L 2200/16; B01L 3/5027; B01L 3/502; B01L 3/50; B01L 3/00; B01L 2200/06; B01L 2200/00; Y10T 436/00; Y10T 436/11; Y10T 436/111666
USPC ..... 436/45, 43; 422/68.1, 50; 210/778, 787, 210/767, 600
See application file for complete search history.

(56) References Cited

U.S. PATENT DOCUMENTS

| | | | | |
|---|---|---|---|---|
| 6,632,399 | B1 * | 10/2003 | Kellogg et al. | 422/72 |
| 6,679,279 | B1 * | 1/2004 | Liu et al. | 137/13 |
| 2008/0156079 | A1 | 7/2008 | Momose et al. | |
| 2008/0296734 | A1 | 12/2008 | Momose | |
| 2009/0098658 | A1 | 4/2009 | Momose et al. | |
| 2009/0104077 | A1 | 4/2009 | Momose | |
| 2009/0111675 | A1 | 4/2009 | Yokogawa et al. | |
| 2009/0135407 | A1 | 5/2009 | Kageyama et al. | |
| 2009/0142232 | A1 | 6/2009 | Okada et al. | |
| 2009/0155125 | A1 | 6/2009 | Michiue et al. | |
| 2009/0232708 | A1 | 9/2009 | Yokogawa et al. | |

FOREIGN PATENT DOCUMENTS

JP 2005-274199 10/2005

OTHER PUBLICATIONS

U.S. Appl. No. 12/467,404, filed May 18, 2009.
U.S. Appl. No. 12/424,913, filed Apr. 16, 2009.

* cited by examiner

*Primary Examiner* — Christine T Mui
(74) *Attorney, Agent, or Firm* — Fish & Richardson P.C.

(57) ABSTRACT

There are provided a microchip provided with a liquid reagent retaining portion that retains the liquid reagent, and a usage thereof, wherein the liquid reagent is sealed into the liquid reagent retaining portion by a sealant inactive to the liquid reagent, exhibiting flowability at the time of using the microchip, and the microchip further has a separating portion to separate the liquid reagent and the sealant, connected to the liquid reagent retaining portion, and the separating portion is composed of a separation tank for separating the liquid reagent and the sealant, and an accommodation tank for accommodating a separated substance, connected to the separation tank by a first flow path.

5 Claims, 6 Drawing Sheets

MICROCHIP AND METHOD OF USING MICROCHIP

BACKGROUND OF THE INVENTION

1. Field of the Invention

The present invention relates to a microchip useful as μ-TAS (Micro Total Analysis System) appropriately used for biochemical test of DNA, protein, cell, immunity and blood, chemical synthesis and environmental analysis, and in further detail, relates to a liquid reagent built-in type microchip having a liquid reagent for mixing with a sample intended for the test and the like built in the microchip previously.

2. Description of the Related Art

In recent years, the importance of sensing, detecting or quantifying biological materials such as DNA (Deoxyribo Nucleic Acid), enzyme, antigen, antibody, protein, virus and cell and chemical materials has increased in the fields of medical care, health, food and drug development, and various biochips and micro chemical chips (hereinafter named generically as microchips) capable of conveniently measuring them have been proposed.

The microchips generally have a fluid circuit inside thereof. In a liquid reagent built-in type microchip having a liquid reagent for treating a sample (such as blood) intended for the test and analysis or reacting with the sample built-in previously, the fluid circuit is mainly composed of, for example, each of a liquid reagent retaining portion to retain the liquid reagent, a measuring portion to measure the sample and the liquid reagent, a mixing portion to mix the sample and the liquid reagent and a detecting portion to analyze and/or test the mixed liquid as well as a minute flow path (for example, a width of approximately several hundred μm) for properly connecting each of these portions.

The microchip having such a fluid circuit has so many advantages that the sample and the reagent are slight in amount, the costs are inexpensive, the reaction rate is high, the high-throughput test may be performed and the test result may be immediately obtained at the site where the sample is gathered, as to be appropriately used for biochemical test such as a blood test, for the reason that a series of experiment and analysis processes performed in a laboratory may be performed in the chip of several centimeters square with a thickness of approximately several millimeters.

Here, in the liquid reagent built-in type microchip, when the liquid reagent sealed into the microchip decreases due to evaporation during the time from production to use of the microchip and the needed amount thereof is not secured at the time of use, the needed amount of the liquid reagent is not measured in the measuring portion, and mixing or reaction are not performed at an exact mixing ratio with the sample, so that the possibility is brought that precise test and analysis may not be performed.

For example, in Japanese Patent Laying-Open No. 2005-274199, as a method for restraining a slight amount of a specimen (a reagent or a sample) in a microchip from evaporating, a method for injecting a reagent and a sample into an internal flow path of a microchip to thereafter seal a flow path opening by injecting other liquid into the internal flow path is described, and the microchip applied to this method is described therein.

However, the microchip described in the above-mentioned Patent Document does not have a means for separating the liquid for sealing (sealing liquid) and the reagent, so that the above-mentioned method can not be directly applied to the microchip such that the reagent and the sample are each measured inside the microchip, and the measured reagent and the measured sample are mixed to perform precise test and analysis. That is to say, the sealing liquid can not be separated from the reagent, so that the reagent can not be exactly measured in the microchip, and thus mixing of the reagent and the sample at an exact mixing ratio, precise test and analysis can not be performed.

SUMMARY OF THE INVENTION

The present invention has been made to solve the above-mentioned problems, and the object thereof is to provide a microchip such that a liquid reagent built in the microchip previously may be prevented from decreasing in liquid amount due to evaporation and leakage, the liquid reagent is exactly measured, and thus precise test and analysis may be performed.

The present invention is the microchip provided with a liquid reagent retaining portion that retains a liquid reagent, wherein the liquid reagent is sealed into the liquid reagent retaining portion by a sealant inactive to the liquid reagent and exhibiting flowability at the time of using the microchip, and the microchip further has a separating portion to separate the liquid reagent and the sealant, connected to the liquid reagent retaining portion, and the separating portion is composed of a separation tank for separating the liquid reagent and the sealant, and an accommodation tank for accommodating a separated substance, connected to the separation tank by a first flow path.

In the microchip of the present invention, the liquid reagent retaining portion and the separating portion are connected by a second flow path, and the sealant may be retained in the second flow path. The separated substance preferably contains the total amount or the approximately total amount of the sealant. The first flow path may have an approximately U shape.

Also, the present invention provides a method of using a microchip including the following steps.

(1) the step of introducing the liquid reagent in the liquid reagent retaining portion and the sealant into the separation tank by applying centrifugal force to the above-mentioned microchip of the present invention, (2) the step of separating in layer the liquid reagent and the sealant in the separation tank by applying centrifugal force to the microchip, and (3) the step of separating a layer of the sealant from a layer of the liquid reagent by applying centrifugal force to the microchip Here, in the case where the above-mentioned first flow path has an approximately U shape, the principle of a siphon may be utilized as a means for separating a layer of the sealant from a layer of the liquid reagent.

The microchip of the present invention allows the liquid reagent built in the microchip to be prevented from decreasing in liquid amount due to evaporation and leakage, and allows only the liquid reagent to be taken out of a mixture of the liquid reagent and the sealant because of having the separating portion to separate the liquid reagent and the sealant. Thus, the liquid reagent may be exactly measured, so that the liquid reagent and the sample (intended for test) may be mixed at an exact mixing ratio, and therefore precise test and analysis may be performed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
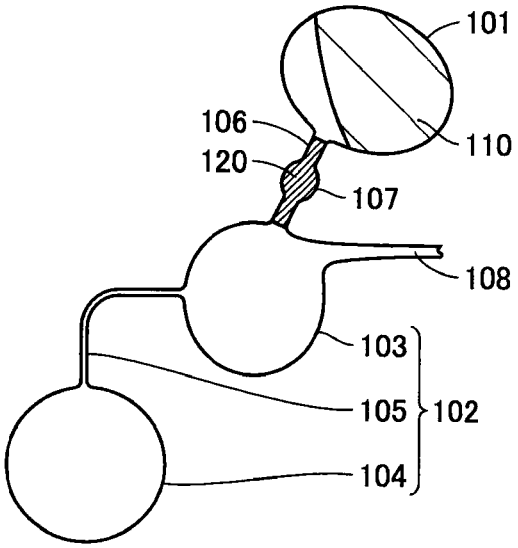
FIG. 1 is a schematic plan view showing an example of the periphery of the liquid reagent retaining portion and the separating portion in the liquid reagent built-in type microchip of a first embodiment according to the present invention.

The present invention relates to a liquid reagent built-in type microchip. Here, "the liquid reagent built-in type microchip" is a microchip having a liquid reagent for treating a sample intended for test and analysis performed by using the microchip (hereinafter referred to as simply a sample, examples of the sample include blood) or reacting with the sample retained inside the microchip previously.

The size of the microchip is not particularly limited and yet may be determined at approximately several centimeters in length and width and approximately several millimeters to one centimeter in thickness, for example. The microchip is typically used by being mounted on a device capable of applying centrifugal force thereto. That is, centrifugal force in a proper direction is applied to the microchip, so that the sample and the liquid reagent are measured and mixed to detect a specific component in a mixed liquid.

The liquid reagent built-in type microchip according to the present invention has a micro fluid circuit structure inside thereof. The micro fluid circuit is not particularly limited and yet is typically provided with a liquid reagent retaining portion to retain the liquid reagent, each of measuring portions to measure the liquid reagent and the injected sample, a separating portion to separate the sealant for sealing the liquid reagent and the liquid reagent, a mixing portion to mix the measured liquid reagent and the measured sample, and a detecting portion to analyze and/or test the obtained mixed liquid. Other portions are provided as required. Here, as described later, the measuring portion to measure the liquid reagent and the separating portion may be one and the same portion.

Each of the above-mentioned portions is disposed in such a proper position that the application of centrifugal force from the exterior allows measurement of the sample and the liquid reagent and mixing of the sample and the liquid reagent and transfer of the mixed liquid to the detecting portion to be sequentially performed, and is connected by a minute flow path (occasionally referred to as simply a flow path hereinafter). The test and analysis of the above-mentioned mixed liquid (such as detection of a specific component in the mixed liquid) are typically performed by optical measurements in which the detecting portion is irradiated with light to detect intensity of transmitted light or absorption spectrum of the mixed liquid retained in the detecting portion is measured or the like, and yet are not limited thereto.

The microchip of the present invention is not particularly limited and yet may be composed of a first substrate and a second substrate laminated and stuck on the first substrate, for example. More specifically, the microchip of the present invention may be produced by laminating the second substrate on the first substrate provided with a groove or grooves on the surface thereof so that the surface of the first substrate on the groove-forming side is opposite to the second substrate. Thus, a fluid circuit consisting of a hollow portion composed of the groove(s) provided on the surface of the first substrate and the surface of the second substrate on the side opposite to the first substrate is formed. The shape and pattern of the groove(s) formed on the surface of the first substrate are not particularly limited and yet determined so that the structure of the hollow portion composed of the groove(s) and the surface of the second substrate becomes a desired and proper fluid circuit structure.

Two or more of substrates may be used for producing the microchip. The materials for the substrates are not particularly limited; for example, plastic substrates may be used.

Hereinafter, the present invention is described in detail by referring to embodiments.

First Embodiment

FIG. 1 is a schematic plan view showing an example of the periphery of the liquid reagent retaining portion and the separating portion of the liquid reagent built-in type microchip of a first embodiment in the present invention. As described above, the microchip of the present invention has the liquid reagent retaining portion and the separating portion as well as the mixing portion and the detecting portion, and the structures thereof are omitted since conventionally known structures can be applied for these structures. The liquid reagent retaining portion and the separating portion and each of other portions compose the fluid circuit of the microchip and are formed inside the microchip, and a specific fluid circuit portions of the microchip is extracted and shown in FIG. 1 (similarly in FIGS. 5 to 7) in order to describe more definitely.

The microchip of the present embodiment has a liquid reagent retaining portion 101 provided with a liquid reagent 110 and a separating portion 102 composed of a separation tank 103, an accommodation tank 104 and a first flow path 105 for connecting separation tank 103 and accommodation tank 104. Liquid reagent retaining portion 101 and separating portion 102 are connected by a second flow path 106. A sealant 120 for sealing liquid reagent 110 into liquid reagent retaining portion 101 is filled into second flow path 106.

Separation tank 103 is a portion where liquid reagent 110 and sealant 120 are separated, and accommodation tank 104 is a tank for accommodating a separated substance (such as the separated sealant). The microchip of the present embodiment is appropriately applied, in the case where contact angle θ of liquid reagent 110 and a mixture of liquid reagent 110 and sealant 120 with the inner wall of the fluid circuit satisfies $\theta>90°$, that is, wettability of liquid reagent 110 and a mixture of liquid reagent 110 and sealant 120 is low.

According to the microchip of the embodiment having the structure as described above, liquid reagent 110 has been sealed by sealant 120 filled into second flow path 106 until the time of use of the microchip, so that liquid reagent 110 may be prevented or restrained from decreasing in liquid amount due to evaporation and leakage.

The microchip of the present embodiment has separating portion 102 for separating liquid reagent 110 and sealant 120, so that only the liquid reagent can be taken out of the liquid reagent and the sealant once mixed. Thus, since the liquid reagent may be exactly measured, the liquid reagent and the sample can be mixed at an exact mixing ratio, and thereby precise test and analysis can be performed. In the embodiment, separating portion 102 serves also as a measuring portion to measure liquid reagent 110. This point will be described later.

Inactive materials exhibiting no reactivity to liquid reagent 110 and exhibiting flowability at the time of using the microchip, being preferably liquid at the time of using the microchip, are used as the materials used as sealant 120. "Exhibiting flowability or being liquid at the time of using the microchip" includes allowing flowability to or liquefying the sealant by heating a region filled with the sealant at the time of using the microchip. The materials for the sealant are preferably materials to be separated in layer from the liquid reagent by the application of centrifugal force. Examples of such materials include mineral oil (liquid paraffin), silicone oil, fluorine oil, vegetable oils (such as sesame oil, rapeseed oil, corn oil and soybean oil), butter, hog oil and cattle oil, considering that liquid reagent 110 is typically an aqueous reagent. Above them, a mineral oil (liquid paraffin) being liquid around normal temperature is preferably used.

The shape of second flow path 106 for connecting liquid reagent retaining portion 101 and separating portion 102 is not particularly limited and may be a structure having a convex portion 107, such that a part thereof protrudes convexly as shown in FIG. 1, or a flow path having a certain diameter without having any convex portions. The flow path diameter except the convex portion in the case of having the convex portion and the flow path diameter in the case of having a certain diameter may be determined at approximately 100 to 500 μm, for example. The placement of convex portion 107 allows the filled amount of sealant 120 to be adjusted by regulating the space volume of the convex portion.

The amount of sealant 120 filled into second flow path 106 is not particularly limited and yet is an amount such that liquid reagent 110 in liquid reagent retaining portion 101 may be prevented from decreasing due to evaporation during the time to use of the microchip to such a degree as to cause inconvenience for test and analysis, preferably an amount such that at least a partial region of second flow path 106 may be completely clogged with sealant 120. More preferably, as shown in FIG. 1, the whole region of second flow path 106 is completely clogged with sealant 120. Both liquid reagent 110 and sealant 120 are supplied to separation tank 103 at the time of using the microchip, and on this occasion, the amount of a mixture of liquid reagent 110 and sealant 120 needs to be determined at such an amount as not to overflow from an outlet 108 of separation tank 103. Accordingly, the amount of the sealant is determined in consideration of also this point.

Figure 2A:
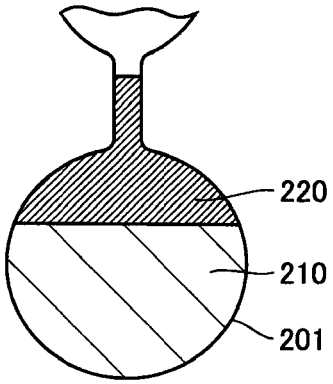
FIGS. 2A and 2B are schematic views showing other examples of a sealing form of the liquid reagent by the sealant.

Here, the spot filled with the sealant is not limited to the inside of the second flow path for connecting the liquid reagent retaining portion and the separating portion, but the sealant may be filled so that a sealant 220 enters a liquid reagent retaining portion 201 to seal the whole liquid surface of a liquid reagent 210 by contacting with liquid reagent 210, as shown in FIG. 2A. Thus, liquid reagent 210 avoids contacting with air, so that the deterioration of liquid reagent 210 due to oxygen and carbon dioxide may be decreased or prevented. Liquid reagent retaining portion 201 may have a longitudinal cylindrical shape (longitude signifies the thickness direction of the microchip); in this case, as shown in FIG. 2B, the same effect as FIG. 2A may be obtained by covering the surface of the layer of liquid reagent 210 with the layer of sealant 220.

Figure 3A:
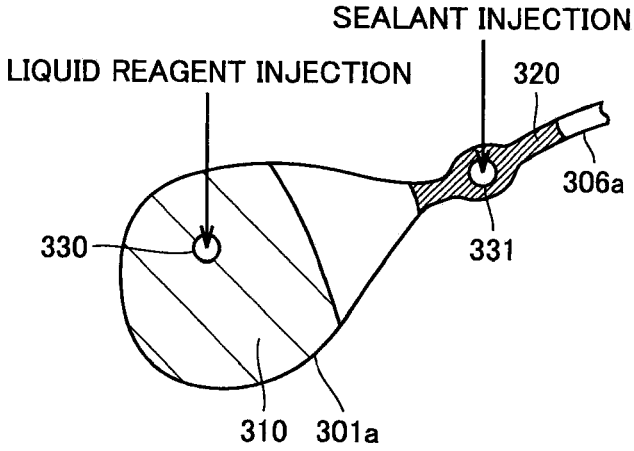
FIGS. 3A to 3C are schematic views showing some examples of a method for filling the liquid reagent and the sealant into the microchip.

Examples of a method for filling the liquid reagent and the sealant into the microchip are not particularly limited and include a method such that a liquid reagent 310 is injected from a through-hole 330 provided on the surface of the microchip, leading to a liquid reagent retaining portion 301*a*, by using an injecting means such as a syringe to thereafter inject a sealant 320 from a through-hole 331 leading to a second flow path 306*a*, as shown in FIG. 3A. Needless to say, the order of injecting may be reverse.

Figure 2B:
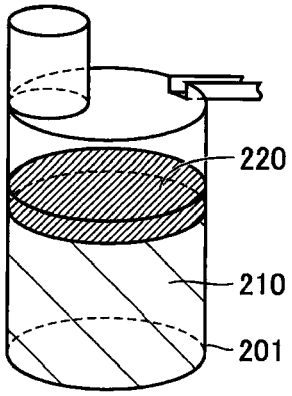
Figure 3B:
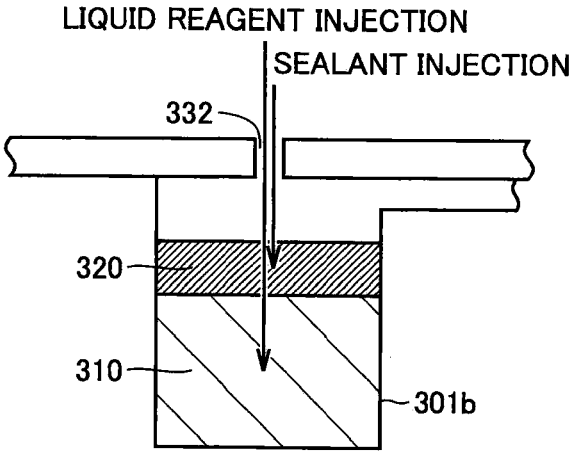

In the case where a liquid reagent retaining portion 301*b* is of a longitudinal cylindrical shape, as shown in FIG. 3B, liquid reagent 310 and sealant 320 are sequentially injected from a through-hole 332 leading to a liquid reagent retaining portion 301*b* by using an injecting means such as a syringe, so that the state of sealing as shown in FIG. 2B can be realized. Needless to say, the order of injecting may be reverse. Also, the liquid reagent and the sealant are simultaneously injected from the through-hole leading to the liquid reagent retaining portion by using an injector 430 capable of simultaneously injecting the liquid reagent and the sealant as shown in FIGS. 4A and 4B, so that the state of sealing as shown in FIG. 2B (or FIG. 3B) may be realized.

Figure 3C:
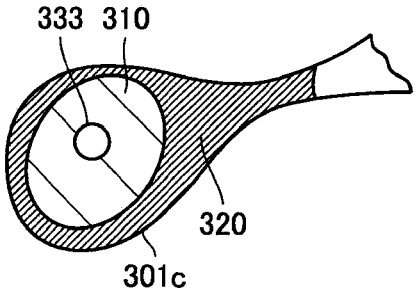

Liquid reagent 310 and sealant 320 are simultaneously injected into a liquid reagent retaining portion 301*c* from a through-hole 333 by using injector 430, so that the state of sealing such that the surface of liquid reagent 310 is covered with sealant 320 as shown in FIG. 3C may be realized.

Figure 4A:
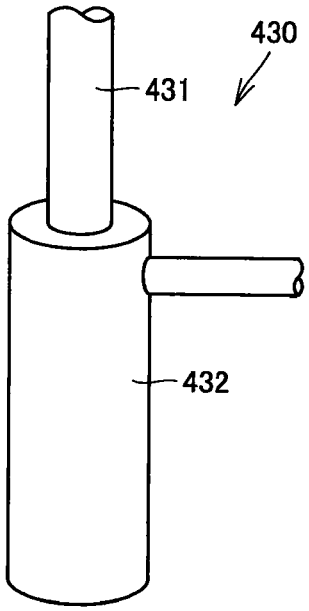
FIGS. 4A and 4B are schematic views showing an example of an injector capable of simultaneously injecting the liquid reagent and the sealant.
Figure 4B:
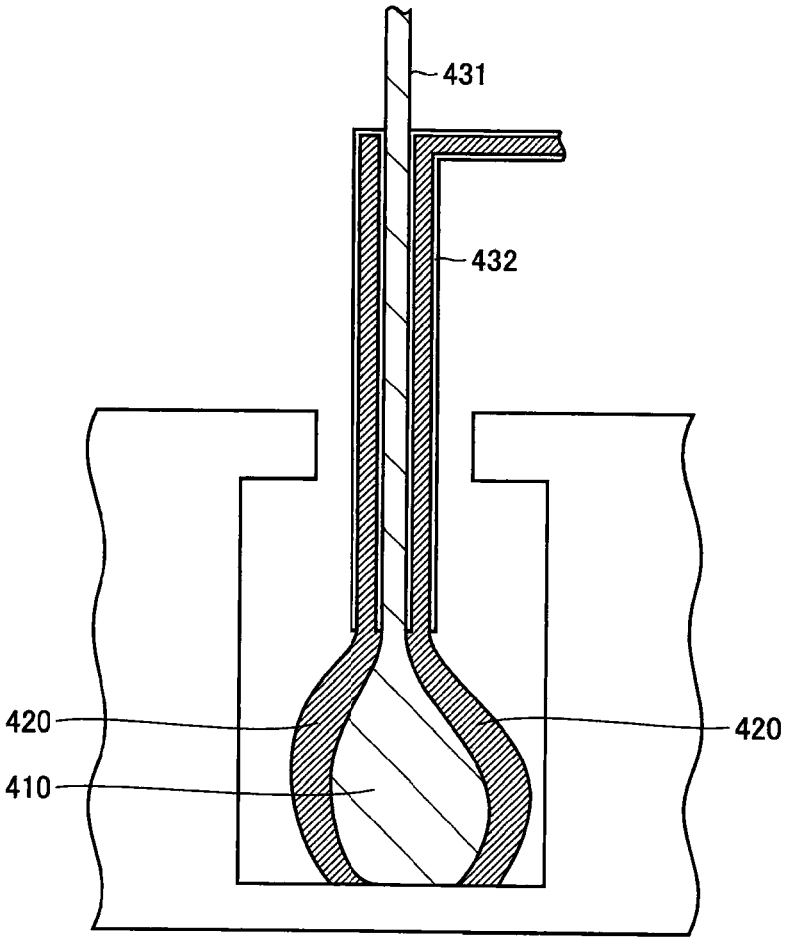

FIGS. 4A and 4B are schematic views showing the structure of injector 430; FIG. 4A is a schematic view showing the external appearance thereof, and FIG. 4B is a schematic cross-sectional view thereof and shows a state such that the liquid reagent and the sealant are simultaneously injected by using this. Injector 430 has a first inlet tube 431 for injecting a liquid reagent 410 and a second inlet tube 432 for injecting a sealant 420, formed so as to surround first inlet tube 431. The use of the injector with such a structure allows the liquid reagent to be prevented from contacting with air also at the time of injecting the liquid reagent, so that the deterioration of the liquid reagent may be prevented or decreased at the time of injecting.

With reference to FIG. 1, separating portion 102 is composed of separation tank 103, accommodation tank 104 and first flow path 105 for connecting separation tank 103 and accommodation tank 104. Separation tank 103 is a portion for separating in layer liquid reagent 110 and sealant 120 in a mixed state to separate these layers. Separated liquid reagent 110 or sealant 120 is accommodated in accommodation tank 104. A part of liquid reagent 110 may be contained in separated sealant 120.

First flow path 105 is as thin a flow path as a flow path diameter of approximately 30 to 500 μm, preferably 100 to 300 μm, and functions as a valve for liquid reagent 110 and a mixture of liquid reagent 110 and sealant 120 with low wettability. That is, these liquids with low wettability (contact angle θ with the inner wall of the fluid circuit satisfies θ>90°) do not leak out to accommodation tank 104 through first flow path 105 unless comparatively strong centrifugal force is applied.

Figure 5:
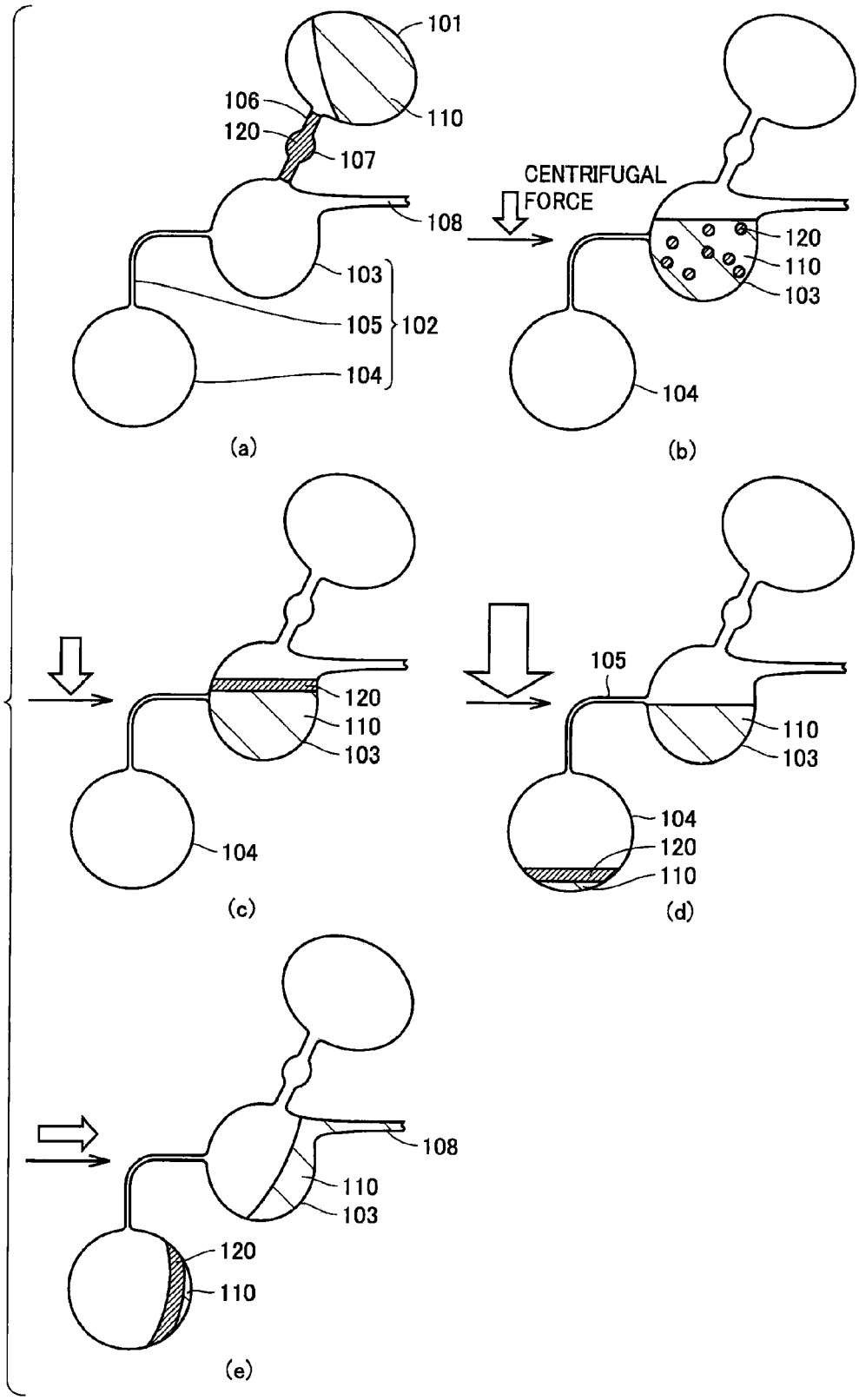
FIG. 5 is a schematic flow chart showing an example of a method of using the microchip of a first embodiment according to the present invention.

Next, a method of using the microchip of the present embodiment is described by referring to FIG. 5. FIG. 5 is a schematic flow chart showing an example of a method of using the microchip of a first embodiment. First, downward centrifugal force as shown in FIG. 5 is applied to the microchip of the embodiment shown in FIG. 5(*a*), so that the sealing by sealant 120 is burst to introduce liquid reagent 110 and sealant 120 to separation tank 103. Then, liquid reagent 110 and sealant 120 are in a mixed state (a dispersed state) (refer to FIG. 5(*b*)). The mixed liquid has a higher liquid level than the connecting location of first flow path 105 in separation tank 103; in the case where the contact angle of the mixed liquid exceeds 90°, first flow path 105 serves for a valve function and the mixed liquid does not flow out to accommodation tank 104. That is, the strength of centrifugal force at this time is determined at a degree such that first flow path 105 may serve for a valve function (the mixed liquid does not flow out).

In addition, when centrifugal force is applied in the same direction (downward) or the above-mentioned downward centrifugal force is continuously applied, separation in layer is caused between liquid reagent 110 and sealant 120, resulting from difference in specific gravity thereof (refer to FIG. 5(*c*)). FIG. 5 shows the case where the specific gravity of sealant 120 is smaller than that of liquid reagent 110. Also at this stage, first flow path 105 serves for a valve function, and liquid reagent 110 and sealant 120 do not flow out to accommodation tank 104.

Next, larger centrifugal force is applied downward, so that the valve is burst to make sealant 120 in the upper layer flow out to accommodation tank 104 through first flow path 105 (refer to FIG. 5(*d*)). Thus, the total amount or the approximately total amount of sealant 120 used for sealing liquid reagent 110 flows out to accommodation tank 104 and is removed. Simultaneously therewith, liquid reagent 110 in separation tank 103 is decreased in amount to a liquid level of the connecting location of first flow path 105. That is, separation tank 103 also functions as a measuring portion to measure the liquid reagent of the amount equivalent to a liquid level of the connecting location of first flow path 105. The excessive liquid reagent flows out to accommodation tank 104 similarly. As described above, according to the microchip of the embodiment having the separating portion, the adjustment of the strength of centrifugal force allows the sealant to be separated in layer and removed from the liquid reagent.

Measured liquid reagent 110 from which sealant 120 is removed is discharged from outlet 108 of separation tank 103 by the application of rightward centrifugal force, and then subjected to the next step (refer to FIG. 5(*e*)). The next step is, for example, mixing with a sample (intended for test), and test analysis of the mixed liquid.

In the case of using a sealant having a larger specific gravity than a liquid reagent, a sealant layer becomes the lower layer through separation in layer. Accordingly, in this case, a constitution such that the accommodation tank is provided on the side of outlet 108 of separation tank 103 to take out the liquid reagent, from which the sealant is removed, through first flow path 105 may be adopted. This point is the same also in the following embodiments.

Second Embodiment

Figure 6:
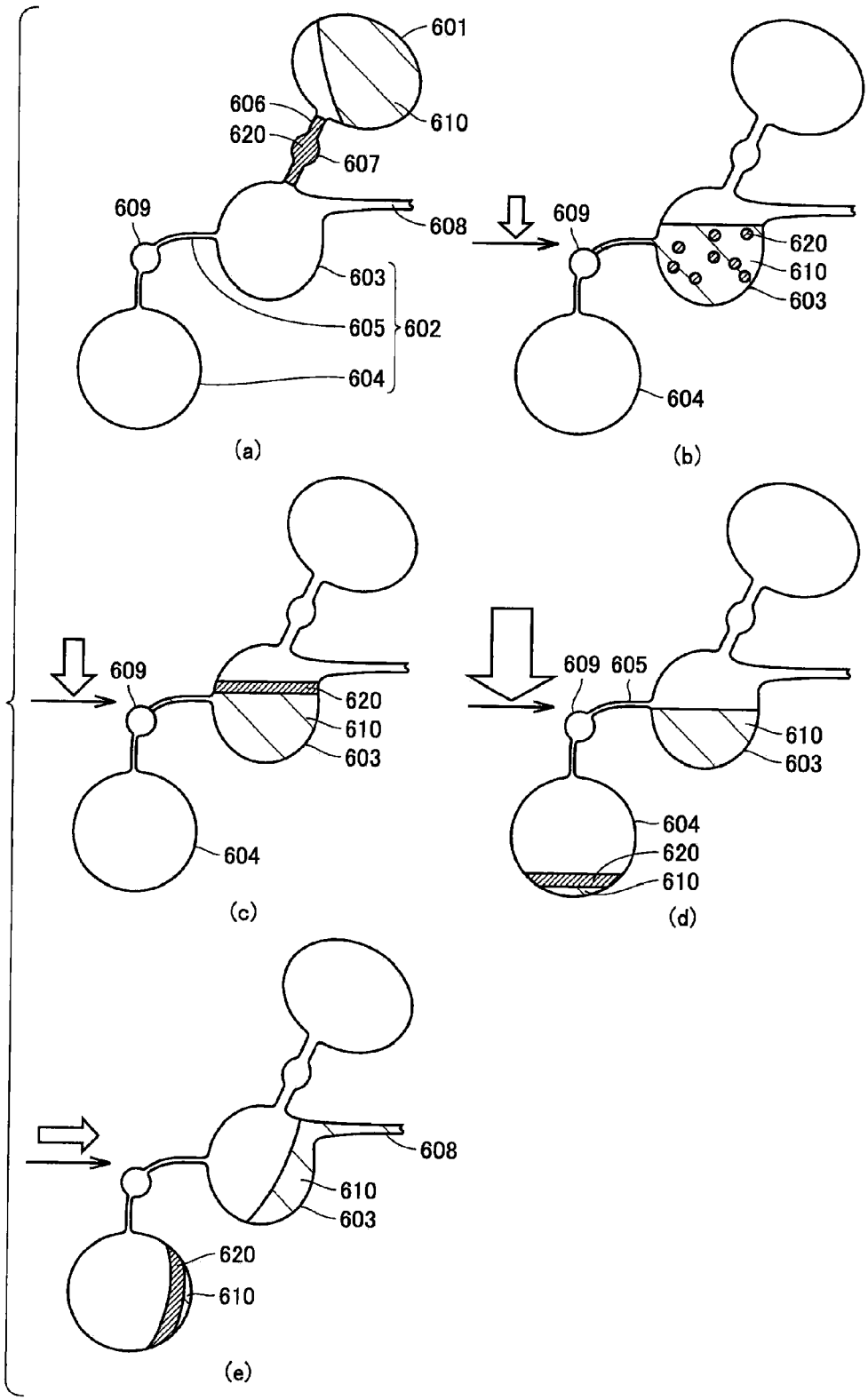
FIG. 6 is a schematic flow chart showing an example of a method of using the microchip of a second embodiment according to the present invention.

FIG. 6 is a schematic flow chart showing an example of a method of using the microchip of a second embodiment. As shown in FIG. 6(*a*), the microchip of the embodiment has a liquid reagent retaining portion 601 provided with a liquid reagent 610 and a separating portion 602 composed of a separation tank 603, an accommodation tank 604 and a first flow path 605 for connecting separation tank 603 and accommodation tank 604. Liquid reagent retaining portion 601 and separating portion 602 are connected by a second flow path 606 having a convex portion 607. Then, a sealant 620 for sealing liquid reagent 610 is filled into second flow path 606.

First flow path 605 has an approximately spherical valve 609 with large flow path diameter. The microchip of the embodiment with such a structure is appropriately applied in the case where contact angle θ of liquid reagent 610 and a mixture of liquid reagent 610 and sealant 620 with the inner wall of the fluid circuit satisfies θ<90°, that is, wettability of liquid reagent 610 and a mixture of liquid reagent 610 and sealant 620 is high. A sealing form by sealant 620 can be modified in the same manner as is described in the above-mentioned first embodiment.

A portion (valve 609) larger in flow path diameter as compared with the flow path diameter of other portions is provided for first flow path 605, whereby liquid high in wettability will stay in a portion smaller in flow path diameter, thus liquid reagent 610 and a mixture of liquid reagent 610 and sealant 620 do not flow out to accommodation tank 604 unless strong centrifugal force is applied to burst the valve. The shape of valve 609 is not limited to a sphere but may be properly a rectangular parallelepiped, and the like.

Next, a method of using the microchip of the present embodiment is described. First, downward centrifugal force is applied to the microchip of the embodiment shown in FIG. 6(*a*), so that the sealing by sealant 620 is burst to introduce liquid reagent 610 and sealant 620 to separation tank 603. At this time, liquid reagent 610 and sealant 620 are in a mixed state (a dispersed state) (refer to FIG. 6(*b*)). In the case where the contact angle of the mixed liquid is less than 90°, the mixed liquid permeates immediately before valve 609 and yet does not flow out to accommodation tank 604 due to the presence of the valve. That is, the strength of centrifugal force at this time is determined at a degree such that the mixed liquid does not flow out to accommodation tank 604 with a burst of the value.

In addition, when centrifugal force is applied in the same direction (downward) or the above-mentioned downward centrifugal force is continuously applied, separation in layer is caused between liquid reagent 610 and sealant 620, resulting from difference in specific gravity thereof (refer to FIG. 6(*c*)). FIG. 6 shows the case where the specific gravity of sealant 620 is smaller than that of liquid reagent 610. Also at this stage, liquid reagent 610 and sealant 620 do not flow out to accommodation tank 604 due to the presence of valve 609.

Next, larger centrifugal force is applied downward, so that valve 609 is burst to make sealant 620 in the upper layer flow out to accommodation tank 604 through first flow path 605 (refer to FIG. 6(*d*)). Liquid reagent 610 in separation tank 603 is decreased in amount and measured to a liquid level of the connecting location of first flow path 605.

As described above, according to the microchip of the embodiment having the separating portion, the adjustment of the strength of centrifugal force allows the sealant to be separated in layer and removed from the liquid reagent. Measured liquid reagent 610 from which sealant 620 is removed is discharged from an outlet 608 of separation tank 603 by the application of rightward centrifugal force, and then subjected to the next step (refer to FIG. 6(*e*)).

Third Embodiment

Figure 7:
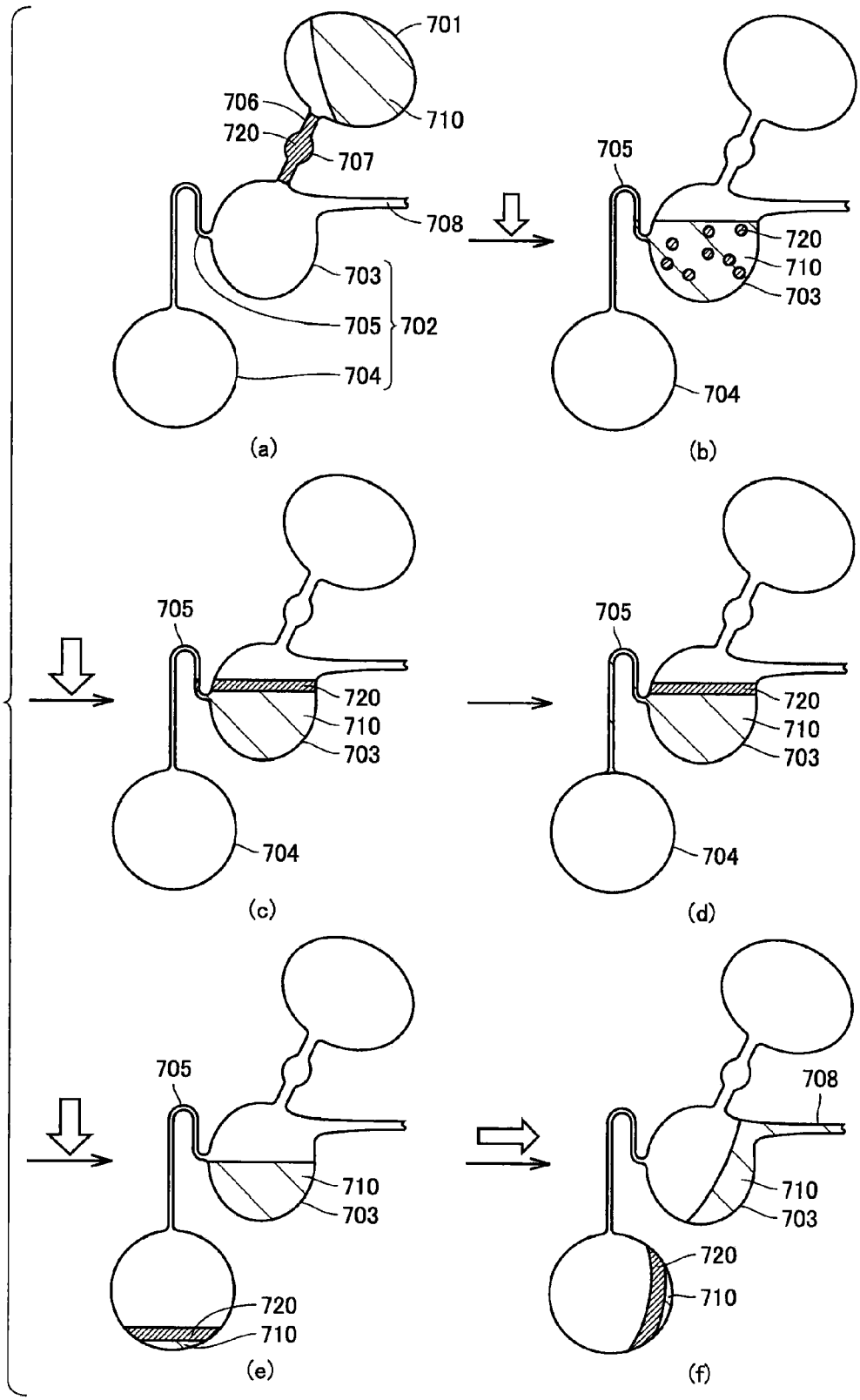
FIG. 7 is a schematic flow chart showing an example of method of using the microchip of a third embodiment according to the present invention.

FIG. 7 is a schematic flow chart showing an example of a method of using the microchip of a third embodiment. As shown in FIG. 7(*a*), the microchip of the embodiment has a liquid reagent retaining portion 701 provided with a liquid reagent 710 and a separating portion 702 composed of a separation tank 703, an accommodation tank 704 and a first flow path 705 for connecting separation tank 703 and accommodation tank 704. Liquid reagent retaining portion 701 and separating portion 702 are connected by a second flow path 706 having a convex portion 707. Then, a sealant 720 for sealing liquid reagent 710 is filled into second flow path 706.

First flow path 705 is formed into an approximately U shape. The microchip of the embodiment with such a structure is appropriately applied in the same manner as the above-mentioned second embodiment in the case where contact angle θ of liquid reagent 710 and a mixture of liquid reagent 710 and sealant 720 with the inner wall of the fluid circuit satisfies θ<90°, that is, wettability of liquid reagent 710 and a mixture of liquid reagent 710 and sealant 720 is high. A sealing form by sealant 720 may be modified in the same manner as is described in the above-mentioned first embodiment.

The shape of first flow path 705 is formed into a U shape as shown in FIG. 7, whereby liquid high in wettability does not flow out to accommodation tank 704 through first flow path 705 while applying downward centrifugal force; on the other hand, when the application of centrifugal force is stopped, the liquid fills first flow path 705 by capillary force, and thereafter when centrifugal force is applied again, the liquid flows out to accommodation tank 704 by the principle of a siphon. The microchip of the embodiment separates sealant 720 from liquid reagent 710 by utilizing such principle of a siphon.

Next, a method of using the microchip of the embodiment is described. First, downward centrifugal force is applied to the microchip of the embodiment shown in FIG. 7(*a*), thereby bursting the sealing by sealant 720 to introduce liquid reagent 710 and sealant 720 to separation tank 703. In this case, liquid reagent 710 and sealant 720 are in a mixed state (a dispersed state) (refer to FIG. 7(*b*)). As long as centrifugal force is continuously applied, first flow path 705 functions as a valve and the mixed liquid does not flow out to accommodation tank 704.

In addition, when centrifugal force is continuously applied in the same direction (downward), separation in layer is caused between liquid reagent 710 and sealant 720, resulting from difference in specific gravity thereof (refer to FIG. 7(*c*)). FIG. 7 shows the case where the specific gravity of sealant 720 is smaller than that of liquid reagent 710. Also at this stage, as long as centrifugal force is continuously applied, first flow path 705 functions as a valve and liquid reagent 710 and sealant 720 do not flow out to accommodation tank 704.

Next, the application of centrifugal force is stopped. Thus, the liquid moves through first flow path 705 by capillary force and leads immediately before accommodation tank 704 (refer to FIG. 7(*d*)). The liquid reagent high in wettability (contact angle θ<90°) is used in the embodiment, so that liquid reagent 710 does not flow out to accommodation tank 704.

Subsequently, downward centrifugal force is applied again and sealant 720 in the upper layer is made to flow out to accommodation tank 704 by utilizing the principle of a siphon (refer to FIG. 7(*e*)). Liquid reagent 710 in separation tank 703 is decreased in amount and measured to a liquid level of the connecting location of first flow path 705.

As described above, according to the microchip of the embodiment having the separating portion, the control of the timing of centrifugal force application allows the sealant to be separated in layer and the sealant can be removed from the liquid reagent. Measured liquid reagent 710 from which sealant 720 is removed is discharged from an outlet 708 of separation tank 703 by the application of rightward centrifugal force, and then subjected to the next step (refer to FIG. 7(*f*)).

Although the present invention has been described and illustrated in detail, it is clearly understood that the same is by way of illustration and example only and is not to be taken by way of limitation, the scope of the present invention being interpreted by the terms of the appended claims.

What is claimed is:

1. A microchip comprising a liquid reagent retaining portion that retains a liquid reagent wherein said liquid reagent is sealed into said liquid reagent retaining portion by a sealant inactive to said liquid reagent and exhibiting flowability at the time of using the microchip, wherein said sealant is disposed in a flow path connecting the liquid reagent retaining portion to a separation tank;

said microchip further has a separating portion to separate a mixture of said liquid reagent and said sealant into said liquid reagent and said sealant, connected to said liquid reagent retaining portion;

said separating portion is composed of:

(a) said separation tank for accepting the mixture and thereafter separating the mixture into said liquid reagent and said sealant by a centrifugal force applied to the microchip, and accommodating the liquid reagent separated by the centrifugal force; and (b) an accommodation tank for accommodating the sealant separated by the centrifugal force, the accommodation tank connected to said separation tank by a first flow path;

the specific gravity of said liquid reagent is larger than that of said sealant;

said first flow path is connected to said separation tank such that said liquid reagent has a higher liquid level in said separation tank than a connection location of said first flow path to said separation tank when the centrifugal force for separating said liquid reagent and said sealant is applied to the microchip; and said separation tank has an outlet for discharging the liquid reagent separated from the sealant.

2. The microchip according to claim 1, wherein said first flow path has an approximately U shape.

3. The microchip according to claim 1, wherein contact angles of said liquid reagent and a mixture of said liquid reagent and said sealant with an inner wall of said first flow path is larger than 90°, and said first flow path prevents said liquid reagent or said mixture leaking out to said accommodation tank as long as a centrifugal force is not applied to the microchip.

4. The microchip according to claim 1, wherein contact angles of said liquid reagent and a mixture of said liquid reagent and said sealant with an inner wall of said first flow path are smaller than 90°, and said first flow path is composed of a first region that generates a capillarity of said liquid reagent or said mixture, a second region that does not generate a capillarity of said liquid reagent or said mixture, and a third region that generates a capillarity of said liquid reagent or said mixture.

5. The microchip of claim 1 wherein the outlet for discharging the liquid reagent separated from the sealant is different from the first flow path connecting the accommodation tank connected to the separation tank.

* * * * *